US012564302B2

(12) United States Patent
Chen et al.

(10) Patent No.: US 12,564,302 B2
(45) Date of Patent: Mar. 3, 2026

(54) CLEANING ROBOT, CLEANING MODULE, CLEANING ASSEMBLY, BASE AND CLEANING SYSTEM

(71) Applicant: SHENZHEN SILVER STAR INTELLIGENT GROUP CO., LTD., Shenzhen (CN)

(72) Inventors: Chuankui Chen, Shenzhen (CN); Li Ma, Shenzhen (CN); Jukang Fang, Shenzhen (CN)

(73) Assignee: SHENZHEN SILVER STAR INTELLIGENT GROUP CO., LTD., Guangdong (CN)

( * ) Notice: Subject to any disclaimer, the term of this patent is extended or adjusted under 35 U.S.C. 154(b) by 375 days.

(21) Appl. No.: 17/900,409

(22) Filed: Aug. 31, 2022

(65) Prior Publication Data

US 2023/0148820 A1 May 18, 2023

(30) Foreign Application Priority Data

Nov. 17, 2021 (CN) ..... 202111363272.4

(51) Int. Cl.
*A47L 11/40* (2006.01)
*A47L 9/00* (2006.01)
(Continued)

(52) U.S. Cl.
CPC ..... *A47L 11/4036* (2013.01); *A47L 9/0063* (2013.01); *A47L 9/02* (2013.01);
(Continued)

(58) Field of Classification Search
CPC ..... A47L 9/0063; A47L 9/2873; A47L 9/02; A47L 9/2847; A47L 9/00; A47L 11/24;
(Continued)

(56) References Cited

U.S. PATENT DOCUMENTS

2017/0210474 A1* 7/2017 Pacheco ..... B64D 11/0696
2020/0000302 A1 1/2020 Morin et al.

FOREIGN PATENT DOCUMENTS

CN 107951448 A 4/2018
CN 111345743 A 6/2020
(Continued)

OTHER PUBLICATIONS

English translation of De 102018000083A1 (Year: 2019).*
(Continued)

*Primary Examiner* — David S Posigian
*Assistant Examiner* — Sukwoo James Chang
(74) *Attorney, Agent, or Firm* — IP & T GROUP LLP

(57) ABSTRACT

The present disclosure provides a cleaning robot, a cleaning module, a cleaning assembly, a base and a cleaning system, wherein the cleaning robot includes: a robot apparatus, configured to carry the cleaning module; and a first replacement mechanism, configured to enable the robot apparatus to be loaded with the cleaning module, and replace a cleaning module carried on the robot apparatus with the loaded cleaning module. When the cleaning robot is loaded with a new cleaning module, the loaded new cleaning module replaces the old cleaning module originally carried on the cleaning robot, in this way, the assembling and disassembling of the cleaning modules on the cleaning robot can be performed synchronously.

13 Claims, 3 Drawing Sheets

(51) Int. Cl.
*A47L 9/02* (2006.01)
*A47L 9/28* (2006.01)
*A47L 11/28* (2006.01)

(52) U.S. Cl.
CPC ..... *A47L 9/2847* (2013.01); *A47L 11/28* (2013.01); *A47L 11/4069* (2013.01); *A47L 11/4091* (2013.01); *A47L 2201/028* (2013.01); *A47L 2201/04* (2013.01)

(58) Field of Classification Search
CPC ..... A47L 11/28; A47L 11/40; A47L 11/4036; A47L 11/4069; A47L 11/4091; A47L 11/4063; A47L 2201/00; A47L 2201/02; A47L 2201/028; A47L 2201/04; A47L 7/02
See application file for complete search history.

(56) References Cited

FOREIGN PATENT DOCUMENTS

| | | | | | |
|---|---|---|---|---|---|
| CN | 212816148 U | | 3/2021 | | |
| CN | 213726306 U | * | 7/2021 | ..... | B01F 15/02 |
| CN | 113413096 A | * | 9/2021 | ..... | A47I 11/24 |
| DE | 102018000083 A1 | * | 7/2019 | ..... | A47L 5/367 |
| EP | 3698700 A1 | | 8/2020 | | |
| WO | WO 2020125774 A1 | * | 6/2020 | ..... | A47L 11/28 |
| WO | 2021/184781 A1 | | 9/2021 | | |

OTHER PUBLICATIONS

English translation of WO 2020125774A1 (Year: 2020).*
English translation of Cn 213726306U (Year: 2021).*
English translation of Cn 113413096A (Year: 2021).*
First Office Action issued by the Chinese patent office for Application No. 202111363272.4 on Jun. 13, 2022.
First Search of priority application No. 202111363272.4.
Office Action for Chinese Patent Application No. 202111363272.4 issued by the Chinese Patent Office on Jun. 13, 2022.
Notice of Grant of Invention Patent Right for Chinese Patent Application No. 202111363272.4 issued by the Chinese Patent Office on Aug. 30, 2022.

* cited by examiner

CLEANING ROBOT, CLEANING MODULE, CLEANING ASSEMBLY, BASE AND CLEANING SYSTEM

CROSS-REFERENCE TO RELATED APPLICATIONS

The present disclosure claims the priority of the Chinese Patent Application No. 2021113632724, entitled as "Cleaning Robot, Cleaning Module, Cleaning Assembly, Base and Cleaning System" filed with the Chinese Patent Office on Nov. 17, 2021, the entire contents of which are incorporated by reference in this disclosure.

TECHNICAL FIELD

The present disclosure relates to the technical field of cleaning devices, and in particular, to a cleaning robot, a cleaning module, a cleaning assembly, a base, and a cleaning system.

BACKGROUND ART

The existing cleaning robot can carry a cleaning module (the cleaning module can be, for example, a water tank, a dust box, or a mopping and wiping part, etc.) for use, wherein when the cleaning module carried on the cleaning robot is to be replaced, the cleaning module carried on the cleaning robot is generally removed from the cleaning robot manually, and then the newly provided cleaning module is manually assembled on the cleaning robot, which process is cumbersome to operate and has low replacement efficiency.

SUMMARY

One purpose of the present disclosure is to propose a cleaning robot, which is simpler and time-saving to replace the cleaning module for the cleaning robot.

In order to solve the above-mentioned technical problems, the present disclosure uses the following technical solutions.

An embodiment of one aspect of the present disclosure provides a cleaning robot, which comprises: a robot apparatus, configured to carry a cleaning module; and a first replacement mechanism, configured to enable the robot apparatus to be loaded with the cleaning module, and enable the cleaning module carried on the robot apparatus to be replaced with the loaded cleaning module.

According to a technical solution of the present disclosure, the first replacement mechanism comprises: a first guide connecting structure, provided on the robot apparatus, wherein a loading portion and an unloading portion are provided on the first guide connecting structure, and the first guide connecting structure is configured to allow the cleaning module to be loaded to the robot apparatus along the loading portion, allow the cleaning module to be separated from the robot apparatus along the unloading portion, and allow the cleaning module to move relative to the robot apparatus along the first guide connecting structure.

According to a technical solution of the present disclosure, the first guide connecting structure comprises one of a push-pull track and a track adaptation part; and/or the first replacement mechanism comprises one first guide connecting structure or at least two first guide connecting structures provided at intervals.

According to a technical solution of the present disclosure, the cleaning robot further comprises: a first connecting structure, configured to be detachably connected to the cleaning module; the first connecting structure is provided in association with the first guide connecting structure to define a preset position, wherein when the cleaning module moves to the preset position along the first guide connecting structure, the first connecting structure is connected with the cleaning module, and when the cleaning module is separated from the preset position, the first connecting structure is detached from the cleaning module.

According to a technical solution of the present disclosure, the first connecting structure comprises at least one of a first fastening part and a first magnetic body.

According to a technical solution of the present disclosure, the cleaning robot further comprises: a recycling and feeding apparatus, configured to store the cleaning module, and feed the stored cleaning module to the first replacement mechanism, and recycle the cleaning module replaced through the first replacement mechanism.

An embodiment of another aspect of the present disclosure provides a cleaning module, which comprises: a body part; and a replacement adaptation structure, provided on the body part, and configured to cooperate with the cleaning robot, so that the cleaning module can be loaded to the cleaning robot and can replace the cleaning module carried on the cleaning robot.

According to a technical solution of the present disclosure, the replacement adaptation structure comprises a second guide connecting structure, the second guide connecting structure is provided on the body part, one end of the second guide connecting structure is provided with a first interface, and the other end thereof is provided with a second interface, the second guide connecting structure is configured to be loaded to the cleaning robot along the first interface and allow the cleaning module to move relative to the cleaning robot (i.e. allow the cleaning module to be movably attached to the cleaning robot), and the second interface is configured to allow the second guide connecting structure to be separated from the cleaning robot along the second interface; the second guide connecting structure comprises one of a push-pull track and a track adaptation part; the replacement adaptation structure comprises one second guide connecting structure or at least two second guide connecting structures provided at intervals; and the body part comprises one or a combination of more of a mopping and wiping part, a water tank, and a dust box.

According to a technical solution of the present disclosure, the cleaning module further comprises: a second connecting structure, configured to be detachably connected to the cleaning robot, wherein the second connecting structure comprises at least one of a second fastening part and a second magnetic body.

An embodiment of another aspect of the present disclosure provides a cleaning assembly, which comprises: a cleaning robot and a cleaning module; the cleaning robot is the cleaning robot described in any one of above-mentioned technical solutions, or the cleaning module is the cleaning module described in any one of above-mentioned technical solutions; and the cleaning module and the cleaning robot is movably attached to the cleaning robot, and through the relative movement between the cleaning module and the cleaning robot, the cleaning module can be loaded to the cleaning robot, and the cleaning module carried on the cleaning robot is replaced with the loaded cleaning module.

An embodiment of another aspect of the present disclosure provides a base, the base can allow the cleaning robot described in any one of above-mentioned technical solutions to park, wherein the base comprises: a recycling and feeding apparatus, configured to store a cleaning module, feed the stored cleaning module to the cleaning robot, and recycle the cleaning module replaced from the cleaning robot.

According to a technical solution of the present disclosure, the recycling and feeding apparatus comprises: a second replacement mechanism, configured to replace the cleaning module stored in the recycling and feeding apparatus with the recycled cleaning module, wherein the cleaning module replaced through the second replacement mechanism is configured to be fed to the cleaning robot.

According to a technical solution of the present disclosure, the recycling and feeding apparatus comprises: a storage apparatus, configured to store the cleaning module; and a first transmission mechanism, configured to transfer the cleaning module between the storage apparatus and the first replacement mechanism.

According to a technical solution of the present disclosure, the recycling and feeding apparatus further comprises a second transmission mechanism, and one of the first transmission mechanism and the second transmission mechanism is configured to receive the cleaning module from the cleaning robot and transfer the cleaning module from the cleaning robot to the storage apparatus, and the other is configured to receive the cleaning module provided by the storage apparatus and transfer to the cleaning robot the cleaning module provided by the storage apparatus; the storage apparatus defines a first opening that opens in a downward position, the first transmission mechanism comprises a pushing mechanism and a lifting mechanism, the pushing mechanism is configured to receive the cleaning module from the cleaning robot, and drive the cleaning module from the cleaning robot to below the first opening, and the lifting mechanism is configured to transfer the cleaning module between the pushing mechanism and the first opening; and the second transmission mechanism is specifically configured to drive the cleaning module to move, and a movement of the cleaning module under the driving of the second transmission mechanism comprises a preset stroke, wherein when the cleaning module is at an initial position of the preset stroke, the cleaning module reaches the first replacement mechanism of the cleaning robot, and when the cleaning module moves from the initial position to an end position of the preset stroke, the cleaning module is loaded to the cleaning robot and replace the cleaning module carried on the robot apparatus.

According to a technical solution of the present disclosure, the storage apparatus comprises: a first storage unit, configured to store the cleaning module from the cleaning robot; and a second storage unit, configured to store the cleaning module for supplying to the cleaning robot.

According to a technical solution of the present disclosure, the storage apparatus further comprises: a channel, communicating with the first storage unit and the second storage unit; a driving part, configured to make a response, in response to an event of the cleaning module entering the first storage unit, to drive the cleaning module to move from the first storage unit along the channel to the second storage unit; and a weight response part, provided in the second storage unit, and configured to detect a weight of the cleaning module in the second storage unit, wherein when the weight of the cleaning module in the second storage unit is greater than or equal to a preset weight, the weight response part causes the second storage unit to discharge the cleaning module in response.

According to a technical solution of the present disclosure, the base further comprises: a cleaning apparatus, configured to perform cleaning processing on the cleaning module recycled in the recycling and feeding apparatus.

An embodiment of another aspect of the present disclosure provides a cleaning system, which comprises: a cleaning robot and a base, the cleaning robot is the cleaning robot described in any one of above-mentioned technical solutions, or the base is the base described in any one of above-mentioned technical solutions.

According to a technical solution of the present disclosure, the cleaning robot can move along a preset trajectory relative to the base, and through the cleaning robot moving along the preset trajectory relative to the base, it can provide a driving force for loading the cleaning module on the base to the cleaning robot and replacing the cleaning module carried on the cleaning robot with the loaded cleaning module.

In the present disclosure, the cleaning robot can carry the cleaning module for use, wherein a first replacement mechanism is provided on the cleaning robot, in this way, when the cleaning robot is loaded with a new cleaning module, the loaded new cleaning module will replace through the first replacement mechanism the old cleaning module originally carried on the cleaning robot, so that the assembling and disassembling of the cleaning modules on the cleaning robot can be performed synchronously, which is more convenient and time-saving for the cleaning robot to replace the cleaning module.

It is to be understood that the foregoing general description and the following detailed description are exemplary only and do not limit the present disclosure.

BRIEF DESCRIPTION OF DRAWINGS

The above and other objects, features and advantages of the present disclosure will become more apparent from the detailed description of embodiments thereof with reference to the drawings.

Figure 1:
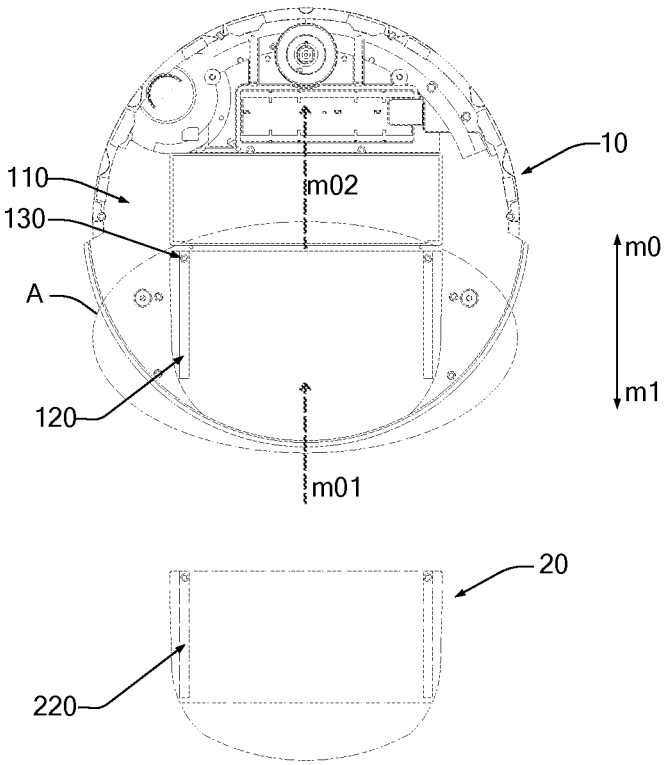
FIG. 1 is a structural schematic view of a cleaning robot according to an embodiment.

REFERENCE SIGNS IN DRAWINGS cleaning robot 10; robot apparatus 110; first replacement mechanism 120; first guide connecting structure 122; loading portion 124; unloading portion 126; first connecting structure 130; first fastening part 132; first magnetic body 134; cleaning module 20; body part 210; replacement adaptation structure 220; second guide connecting structure 222; first interface 224; second interface 226; second connecting structure 230; second fastening part 232; second magnetic body 234; cleaning module NO; cleaning module N1; cleaning module N2; cleaning module N4; cleaning module N5; base 30; recycling and feeding apparatus 300; storage apparatus 310; first storage unit 312; second storage unit 314; channel 3162; driving part 3164; weight response part 3168; support part 318; first transmission mechanism 320; pushing mechanism 322; lifting mechanism 324; second transmission mechanism 330; control system 340; detection part 350.

DETAILED DESCRIPTION OF EMBODIMENTS

Although the present disclosure may readily be embodied in different forms of embodiment, only some of the embodiments are shown in the drawings and will be described in detail in the present disclosure, and simultaneously, it can be understood that this specification should be regarded as an exemplary illustration of the principles of the present disclosure, and is not intended to limit the present disclosure to that described herein.

Thus, a feature indicated in the present disclosure will be used to describe one of the features of an embodiment of the present disclosure without implying that every embodiment of the present disclosure must have the stated feature. Furthermore, it should be noted that this specification describes a number of features. Although some features may be combined together to illustrate possible system designs, these features may also be used in other combinations not explicitly stated. Thus, unless otherwise stated, the combinations described are not intended to limit it.

In the embodiments shown in the drawings, direction indications (such as m0, m01, m02, m1, etc.)/position indications (such as S1, S2, z0, z1, etc.) are used to explain that the structure and movement of the various elements in the present disclosure are not absolute but relative. These descriptions are appropriate when these elements are in the positions shown in the drawings. If the description of the positions of these elements changes, the indications of these directions change accordingly.

Exemplary embodiments will now be described more fully with reference to the drawings. However, exemplary embodiments can be embodied in various forms and should not be construed as limited to the examples set forth herein; on the contrary, these exemplary embodiments are provided so that the description of the present disclosure will be thorough and complete, and will fully convey the concept of exemplary embodiments to those skilled in the art. The drawings are merely schematic illustrations of the present disclosure and are not necessarily drawn to scale. The same reference signs in the drawings denote the same or similar parts, and thus their repeated descriptions will be omitted.

The preferred embodiments of the present disclosure will be further described in detail below with reference to the drawings of the present specification.

Referring to FIG. 1, FIG. 1 is a structural schematic view of a cleaning robot according to an embodiment of the present disclosure.

An embodiment of one aspect of the present disclosure provides a cleaning robot 10, wherein the cleaning robot 10 may be, for example, a household or commercial floor mopping robot, vacuum cleaner, steam mop, etc., which is used for performing the cleaning and dust collecting on a target environment or a target area.

In the above, as shown in FIG. 1, the cleaning robot 10 includes a robot apparatus 110 and a first replacement mechanism 120.

The cleaning module 20 can be carried on the robot apparatus 110. It can be understood that, for the cleaning robot 10 capable of carrying the cleaning module 20, the robot apparatus 110 may be specifically understood as a component or apparatus of the cleaning robot 10 for carrying the cleaning module 20. For example, for a floor mopping robot, the robot apparatus 110 is specifically, for example, a movable body of the floor mopping robot, and the movable body can carry a mopping and wiping part and perform the mopping and wiping on the target area or target environment for cleaning through movement. For another example, for a vacuum cleaner, the robot apparatus 110 can be specifically, for example, a suction head, and the suction head can carry a brush head or a mopping and wiping part and can perform through the movement a cleaning or a mopping and wiping on the target area or target environment for cleaning. For another example, for a steam mop, the robot apparatus 110 may be specially, for example, a mop body, the mop body can carry a cleaning module 20 such as a water tank or a mopping and wiping part, and can perform through the movement a mopping and wiping on the target area or target environment for cleaning.

A first replacement mechanism 120 is configured to enable the robot apparatus 110 to be loaded with the cleaning module 20, and enable a cleaning module 20 carried on the robot apparatus 110 to be replaced with the loaded cleaning module 20. In this way, when a new cleaning module 20 is loaded to the cleaning robot 10, the loaded new cleaning module 20 replaces through the first replacement mechanism 120 the old cleaning module 20 originally carried on the cleaning robot 10, so that the assembling and disassembling of cleaning modules 20 on the cleaning robot 10 can be performed synchronously, which is more convenient and time-saving for the cleaning robot 10 to replace the cleaning module 20.

Specifically, for example, a cleaning module 20 being carried on the robot apparatus 110 is taken as an example for illustration. As shown in FIG. 1, it is achieved through the first replacement mechanism 120: when a new cleaning module 20 is loaded to the robot apparatus 110, the new cleaning module 20 will gradually occupy the connection or position of the old cleaning module 20 on the robot apparatus 110 as the proceeding of loading process, so that the old cleaning module 20 whose connection or position is occupied is gradually removed from the robot apparatus 110, and when the new cleaning module 20 completely occupies the connection or position of the old cleaning module 20 on the robot apparatus 110, the new cleaning module 20 replaces the old cleaning module 20 to occupy the connection or position thereof on the robot apparatus 110, so as to be carried on the robot apparatus 110, while the old cleaning module 20 is separated from the robot apparatus 110 as the connection or position is occupied, thus achieving the replacement of the old cleaning module 20 with the new cleaning module 20.

It can be understood that, for the case that multiple cleaning modules 20 can be carried on the robot apparatus 110 at the same time, it can be correspondingly understood that, through the first replacement mechanism 120: when a preset number (such as 1, 2, 3, 4, etc.) of new cleaning modules 20 are loaded, a preset number (such as 1, 2, 3, 4, etc.) of the old cleaning modules 20 are correspondingly replaced.

It can be understood that the new and old described herein do not intend to limit the difference between the new and old cleaning modules 20, but are a popular expression used to easily distinguish the change in the positional relationship between the two cleaning modules 20. The structures of new cleaning module 20 and old cleaning module 20 are the same, and they only have different identities or names or states with different usage scenarios. Those skilled in the art can also use other expressions based on different expression habits to call the new cleaning module 20 or the old cleaning module 20, for example, the first cleaning module 20 is used instead of the new cleaning module 20, the second cleaning module 20 is used instead of the old cleaning module 20, and so on.

Figure 2:
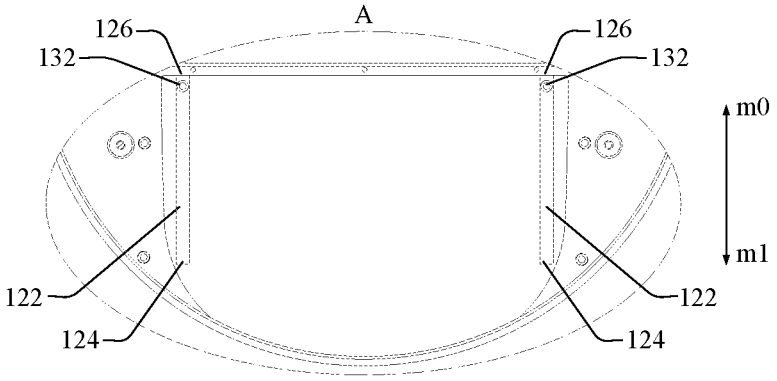
FIG. 2 is a schematic view of an enlarged structure of part A shown in FIG. 1.

In some embodiments, as shown in FIG. 2, the first replacement mechanism 120 includes a first guide connecting structure 122, a first guide connecting structure 122 is provided on the robot apparatus 110, wherein a loading portion 124 and an unloading portion 126 are provided on the first guide connecting structure 122, and the first guide connecting structure 122 is configured to allow the cleaning module 20 to be loaded to the robot apparatus 110 along the loading portion 124, allow the cleaning module 20 to be separated from the robot apparatus 110 along the unloading portion 126, and allow the cleaning module 20 to move relative to the robot apparatus 110 along the first guide connecting structure 122.

In this way, as shown in FIG. 2, the relationship between the cleaning module 20 and the first guide connecting structure 122 can be realized as the following (taking the movement process in a m0 direction as an example for illustration): after the cleaning module 20 is loaded from the loading portion 124 to the robot apparatus 110 in a m01 direction, it can continue to move relative to the robot apparatus 110 in the m0 direction through the guide of first guide connecting structure 122, and finally is separated from the robot apparatus 110 from the unloading portion 126 in the m01 direction.

In this way, when the old cleaning module 20 is originally carried on the robot apparatus 110, during the process that the loaded new cleaning module 20 is loaded to the robot apparatus 110 in the m01 direction and moves along the first guide connecting structure 122, the old cleaning module 20 originally carried on the robot apparatus 110 based on the first guide connecting structure 122 will be pushed out from the position of the unloading portion 126 in a m02 direction, so as to achieve the replacement of the cleaning module 20, which has the advantages of simple structure, convenient assembly, and simple and convenient operation.

Optionally, the first guide connecting structure 122 includes one of a push-pull track and a track adaptation part (the track adaptation part is specifically, for example, a support seat, a bearing, a sliding block, etc. that can be adapted to the push-pull track).

Optionally, as shown in FIG. 2, the first replacement mechanism 120 includes two first guide connecting structures 122 provided at intervals. In this way, the relative movement between the cleaning module 20 and the robot apparatus 110 is smoother and more stable.

Of course, the present design is not limited to this, and in other embodiments, one first guide connecting structure 122 or three or more first guide connecting structures 122 provided at intervals may also be provided.

In some embodiments, as shown in FIG. 2, the cleaning robot 10 further includes a first connecting structure 130, and the first connecting structure 130 is configured to be detachably connected with the cleaning module 20. In this way, when the cleaning module 20 is carried on the robot apparatus 110, it can be firmer and more stable, and it is not easy to be loosened during the operation of the robot apparatus 110.

Optionally, the first connecting structure 130 may be specifically provided on the robot apparatus 110, or may be also provided on the first guide connecting structure 122.

In some specific embodiments, the first connecting structure 130 is provided in association with the first guide connecting structure 122 to define a preset position, wherein when the cleaning module 20 moves to the preset position along the first guide connecting structure 122, the first connecting structure 130 is connected with the cleaning module 20, and when the cleaning module 20 is separated from the preset position, the first connecting structure 130 is detached from the cleaning module 20.

In this way, in the process that the new cleaning module 20 moves along the first guide connecting structure 122 to gradually occupy the preset position, the old cleaning module 20 will be driven to be separated from the preset position, thus realizing that the connection between the new cleaning module 20 and the first connecting structure 130 is synchronized with the disassembly of the old cleaning module 20 and the first connecting structure 130, making the replacement process smoother, and guaranteeing the efficiency and reliability of the replacement of the cleaning module 20.

Optionally, the first connecting structure 130 comprises at least one of a first fastening part 132 and a first magnetic body 134.

In a specific embodiment, as shown in FIG. 1 and FIG. 2, the first replacement mechanism 120 includes a first guide connecting structure 122. The first guide connecting structure 122 is specifically a push-pull track. Two push-pull tracks are provided, and the two push-pull tracks are provided on the bottom surface of the machine body apparatus at an interval.

Two ends of the two push-pull tracks have structures that can allow the loading or detachment of the cleaning module 20, so that one end is used as the loading portion 124 for the loading of the cleaning module 20, and the other end is used as the unloading portion 126 for the unloading of the cleaning module 20, during the replacement process.

A first fastening part 132 is provided at the position between the two ends of the push-pull track, the first fastening part 132 is specifically a latch fastener, which is used for being snapped with the cleaning module 20 when the cleaning module 20 is located in a preset position, and relieving the fastening connection with the cleaning module 20 when the cleaning module 20 is separated from the preset position.

Optionally, the first fastening part 132 is closer to the unloading portion 126 than the loading portion 124.

Figure 3:
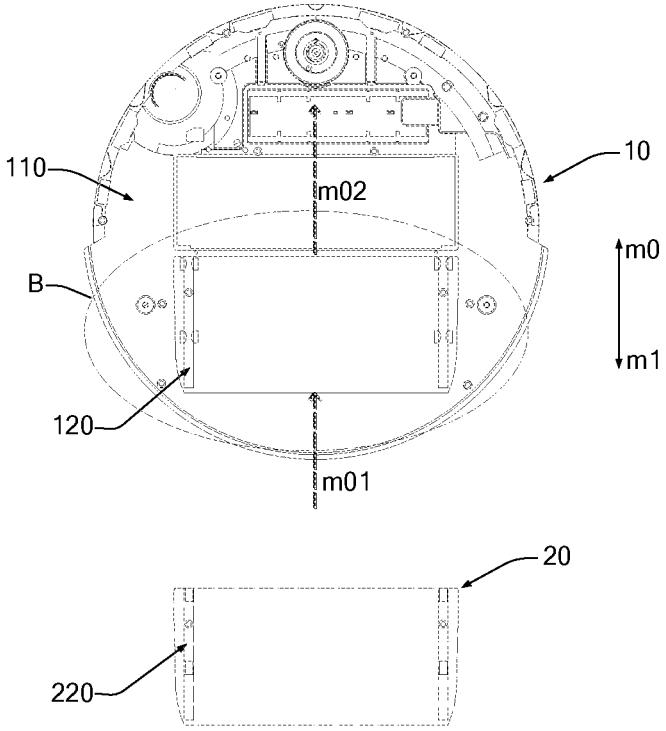
FIG. 3 is a structural schematic view of the cleaning robot according to an embodiment.
Figure 4:
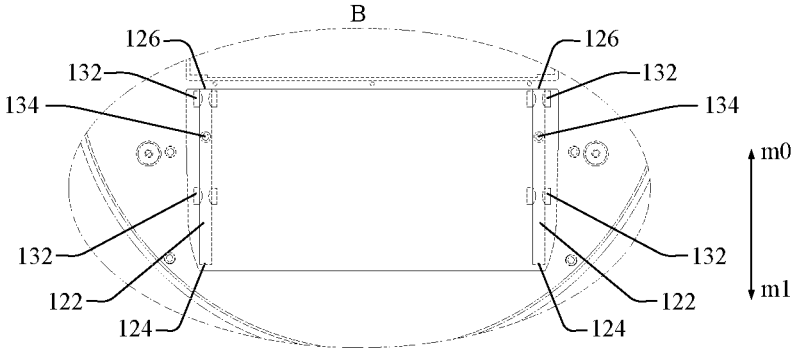
FIG. 4 is a schematic view of an enlarged structure of part B shown in FIG. 3.

In another specific embodiment, as shown in FIG. 3 and FIG. 4, compared with the above-mentioned specific embodiments, the differences include that: the specific structure and composition of the first connecting structure 130 are different.

In this specific embodiment, the first connecting structure 130 includes two first fastening parts 132 and a first magnetic body 134, the two first fastening parts 132 are provided at an interval in an extension direction of the push-pull track, and the first magnetic body 134 is located between the two first fastening parts 132.

More specifically, the first fastening part 132 includes two spring fastening parts, and the two spring fastening parts define a fastening groove therebetween. When the cleaning module 20 moves to the preset position along the push-pull track, two fastening grooves are in one-to-one fastening with two spring fastening parts on the cleaning module 20, and the first magnetic body 134 is magnetically connected to (in magnetic suction connection with) the second magnetic body 234 on the cleaning module 20; when the cleaning module 20 is separated from the preset position, the fastening grooves are separated from the spring fastening parts, and the first magnetic body 134 and the second magnetic body 234 are dislocated.

In some embodiments, the cleaning robot 10 further includes a recycling and feeding apparatus 300, and the recycling and feeding apparatus 300 is configured to store the cleaning module 20, feed the stored cleaning module 20 to the first replacement mechanism 120, and recycle the cleaning module 20 replaced through the first replacement mechanism 120. In this way, there is no need to manually replace the cleaning module 20, which has a better use experience, and enables more intelligent product, and the cleaning robot 10 can replace and recycle the cleaning module 20 in situ by itself, and the cleaning robot 10 does not need to return to the base 30 to replace the cleaning module 20, which is more conducive to the cleaning efficiency of the cleaning robot 10, and based on the first replacement mechanism 120, replacement between the new and old cleaning modules 20 can be achieved in the form of taking-over, the structure is simpler, the volume and weight of the cleaning robot 10 will not be increased too much, the cleaning robot 10 can automatically replace the cleaning module 20 more efficiently, and the replacement steps are fewer and simpler, which not only satisfy the automatic replacement function, but also facilitates the simplification of the control program of the cleaning robot 10.

For a more detailed description of the structure of the recycling and feeding apparatus 300, corresponding understanding can be performed with reference to the description of the recycling and feeding apparatus 300 in other embodiments below, which will not be repeated herein.

Figure 5:
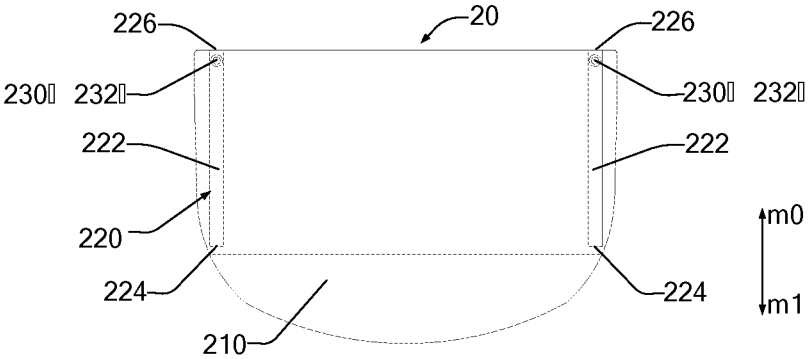
FIG. 5 is a structural schematic view of a cleaning module according to an embodiment.

Referring to FIG. 5, FIG. 5 is a structural schematic view of the cleaning module 20 according to an embodiment of the present disclosure.

An embodiment of an aspect of the present disclosure provides a cleaning module 20, which can be carried on the cleaning robot 10 described in any one of the above embodiments for use.

Specifically, the cleaning module 20 includes a body part 210 and a replacement adaptation structure 220, wherein the replacement adaptation structure 220 is provided on the body part 210, and configured to cooperate with the cleaning robot 10, so that the cleaning module 20 can be loaded to the cleaning robot 10 and can replace the cleaning module 20 carried on the cleaning robot 10.

In this way, when a new cleaning module 20 is loaded to the cleaning robot 10, the loaded new cleaning module 20 can replace the old cleaning module 20 originally carried on the cleaning robot 10 through the cooperation of the replacement adaptation structure 220 with the cleaning robot 10. In this way, the cleaning modules 20 on the cleaning robot 10 can be assembled and disassembled synchronously, and the replacement of the cleaning module 20 on the cleaning robot 10 is simpler, more convenient and time-saving.

In the above, it can be understood that the cleaning module 20 provided in this embodiment can be used as the new cleaning module 20 mentioned above to replace the old cleaning module 20, and can also be the old cleaning module 20 and can be replaced by a new cleaning module 20.

In some embodiments, as shown in FIG. 5, the replacement adaptation structure 220 comprises a second guide connecting structure 222, the second guide connecting structure 222 is provided on the body part 210, one end of the second guide connecting structure 222 is provided with a first interface 224, and the other end thereof is provided with a second interface 226, the second guide connecting structure 222 is configured to be loaded to the cleaning robot 10 along the first interface 224 and allow the cleaning module 20 to be movably attached to the cleaning robot 10, and the second interface 226 is configured to allow the second guide connecting structure 222 to be separated from the cleaning robot 10 along the second interface 226.

In this way, in the scene that the cleaning module 20 is used as the new cleaning module 20, the second guide connecting structure 222 can cooperate with the cleaning robot 10 along the first interface 224, so that the second guide connecting structure 222 can be combined on the cleaning robot 10, so as to meet the use as the new cleaning module 20. In the scene that the cleaning module 20 is used as the old cleaning module 20, the cleaning module 20 can be pushed by the loaded cleaning module 20 along the second guide connecting structure 222, so that the second guide connecting structure 222 can be gradually separated from the cleaning robot 10 along the second interface 226, so as to meet the use as the old cleaning module 20. Therefore, the cleaning module 20 and the cleaning robot 10 can be assembled and disassembled in a form of taking-over, which is convenient and efficient to assemble and disassemble, and has the advantages of simple structure and convenient operation.

Optionally, the second guide connecting structure 222 comprises one of a push-pull track and a track adaptation part (the track adaptation part is specifically, for example, a support seat, a bearing, a sliding block, etc. that can be adapted to the push-pull track).

Optionally, as shown in FIG. 5, the replacement adaptation structure 220 includes two second guide connecting structures 222 provided at an interval. In this way, the relative movement between the cleaning module 20 and the robot apparatus 110 is smoother and more stable.

Of course, the present design is not limited to this, and in other embodiments, one second guide connecting structure 222 or three or more second guide connecting structures 222 provided at intervals may also be provided.

In some embodiments, optionally, the body part 210 includes one or a combination of more of a mopping and wiping part, a water tank, and a dust box.

In some embodiments, as shown in FIG. 5, the cleaning module 20 further includes a second connecting structure 230, and the second connecting structure 230 is configured to be detachably connected with the cleaning robot 10. In this way, when the cleaning module 20 is carried on the robot apparatus 110, it can be firmer and more stable, and is not easily loosened during the operation of the robot apparatus 110.

Optionally, the second connecting structure 230 may be specifically provided on the body part 210, or may also be provided on the second guide connecting structure 222.

In some specific embodiments, the second connecting structure 230 is adapted to the first connecting structure 130 of the cleaning robot 10. When the cleaning module 20 moves to the preset position along the second guide connecting structure 222, the second connecting structure 230 is connected with the first connecting structure 130 of the cleaning robot 10. When the cleaning module 20 is separated from the preset position, the second connecting structure 230 is disassembled from the first connecting structure 130 of the cleaning robot 10.

Optionally, the second connecting structure 230 includes at least one of the second fastening part 232 and the second magnetic body 234.

In one specific embodiment, as shown in FIG. 5, the replacement adaptation structure 220 includes a second guide connecting structure 222. The second guide connecting structure 222 is specifically a track adaptation part, the track adaptation part is specifically, for example, a support seat, a bearing, a sliding block, etc. that can be adapted to a push-pull track. Two track adaptation parts are provided, and the two track adaptation parts are provided on the bottom surface of the body part 210 at an interval.

Two ends of the two track adaptation parts are in a structure that can allow the loading or detachment of the cleaning module 20, so that during the process of replacement, one end serves as the first interface 224 for enabling the cleaning module 20 to be docked and loaded to the cleaning robot 10, and the other end serves as the second interface 226 for enabling the cleaning module 20 to be unloaded from the cleaning robot 10.

A second fastening part 232 is provided at the position between the two ends of the track adaptation part, the second fastening part 232 is specifically a latch fastener, which is used for being snapped with the cleaning robot 10 when the cleaning module 20 is located in a preset position, and relieving the fastening connection with the cleaning robot 10 when the cleaning module 20 is separated from the preset position.

Optionally, the second fastening part 232 is closer to the second interface 226 than the first interface 224.

Figure 6:
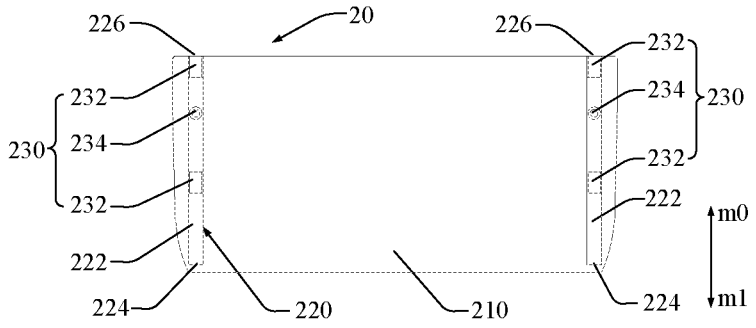
FIG. 6 is a structural schematic view of the cleaning module according to an embodiment.

In another specific embodiment, as shown in FIG. 6, compared with the above-mentioned specific embodiments, the differences include that: the specific structure and composition of the second connecting structure 230 are different.

In this specific embodiment, the second connecting structure 230 includes two second fastening parts 132 and a second magnetic body 234, the two second fastening parts 232 are provided at an interval in an extension direction of the track adaptation part, and the second magnetic body 234 is located between the two second fastening parts 232.

More specifically, the second fastening part 232 includes a spring fastening part. When the cleaning module 20 moves to the preset position along the push-pull track, two spring fastening parts are snapped/fastened with two fastening grooves on the cleaning robot 10, and the second magnetic body 234 is magnetically connected to the first magnetic body 134 on the cleaning robot 10; when the cleaning module 20 is separated from the preset position, the spring fastening parts is released/separated from the fastening grooves, and the first magnetic body 134 and the second magnetic body 234 are dislocated.

An embodiment of another aspect of the present disclosure provides a cleaning assembly (specifically, it can be understood with reference to FIG. 1 and FIG. 3), which comprises a cleaning robot 10 and a cleaning module 20.

In the above, the cleaning robot 10 is the cleaning robot 10 according to any one of above-mentioned technical solutions, or the cleaning module 20 is the cleaning module 20 according to any one of above-mentioned technical solutions; and the cleaning module 20 is movably attached to the cleaning robot the cleaning robot 10, and through the relative movement between the cleaning module 20 and the cleaning robot 10, the cleaning module 20 can be loaded to the cleaning robot 10, and the cleaning module 20 carried on the cleaning robot 10 is replaced with the loaded cleaning module 20.

A Specific Embodiment

As shown in FIG. 1, this specific embodiment provides a cleaning assembly, which includes a cleaning robot 10 and a cleaning module 20. As shown in FIG. 2 and FIG. 5, a push-pull track is provided on one of the cleaning robot 10 and the cleaning module 20, and a track adaptation part is provided on the other. The track adaptation part can be matched with (cooperate with) the push-pull track, so that the cleaning module 20 is connected to the cleaning robot 10 and can slide relative to the cleaning robot 10. The two ends of the push-pull track and the two ends of the track adaptation part are respectively open, so that the track adaptation part can slide into the push-pull track or leave the push-pull track from the end of the push-pull track.

A movable lock component is provided between the track adaptation part and the push-pull track (it can be understood with reference to the first fastening part 132 and the second fastening part 232). The cleaning module 20 make the track adaptation part slide into the push-pull track along a straight line through a pushing force provided by the recycling and feeding apparatus 300, or a pushing force provided by the user manually. The movable lock component on the track adaptation part is combined with the movable lock component on the push-pull track, so that the cleaning module 20 is placed on the cleaning robot 10.

When it needs to be replaced with a new cleaning module 20, the new cleaning module 20 is advanced from the fitting docking position of the cleaning robot 10, so that the track adaptation part between the new cleaning module 20 and the cleaning robot 10 cooperates with the push-pull track, and the old cleaning module 20 on the cleaning robot 10 is replaced by sliding between the track adaptation part and the push-pull track.

A Specific Embodiment

As shown in FIG. 3, this specific embodiment provides a cleaning assembly, which includes a cleaning robot 10 and a cleaning module 20. As shown in FIG. 4 and FIG. 6, a push-pull track is provided on one of the cleaning robot 10 and the cleaning module 20, and the track adaptation part is provided on the other. The differences from the above-mentioned specific embodiments include the following.

In this specific embodiment, two fastening grooves defined by the spring fastening parts are provided at an interval on the push-pull track in an extending direction, the first magnetic body 134 is provided between the two fastening grooves, and two spring fastening parts are provided at an interval on the track adaptation part in an extending direction, and a second magnetic body 234 is provided between the two spring fastening parts.

The implementation is as follows: the cleaning module 20 is driven by the pushing force provided by the recycling and feeding apparatus 300 or user, so that the track adaptation structure on the cleaning module 20 slides into the push-pull track on the cleaning robot 10 along a straight line. When the cleaning module 20 moves to the preset position along the push-pull track, the second magnetic body 234 (e.g., the negative-polarity magnetic component) on the track adaptation structure and the first magnetic body 134 (e.g., the positive-polarity magnetic component) on the push-pull track are combined with each other under the action of magnetic force, and the track adaptation structure and the push-pull track are snapped with each other through the spring fastening parts and the spring fastening parts, so that the cleaning module 20 and the cleaning robot 10 are tightly combined with each other, in this way, the cleaning module 20 of the cleaning robot 10 will not fall off during the cleaning work.

When the new cleaning module 20 is driven by the pushing force provided by the recycling and feeding apparatus 300 or user, so that the track adaptation structure on the new cleaning module 20 slides into the push-pull track on the cleaning robot 10 along a straight line, the new cleaning module 20 can be assembled on the cleaning robot 10 with reference to the above-mentioned process, and during the assembly process of the new cleaning module 20 and the cleaning robot 10, the following are performed synchronously: the old cleaning module 20 moves away from the preset position under the action of pushing force provided by the new cleaning module 20, so that the spring fastening parts and the spring fastening parts between the old cleaning module 20 and the cleaning robot 10 are automatically disconnected and the acting force of the magnetic component is released, and the old cleaning module 20 is pushed, in a straight line, out from the push-pull track by the new cleaning module 20, so that the old cleaning module 20 is separated from the cleaning robot 10, thus, the new cleaning module 20 can replace the old cleaning module 20.

Figure 7:
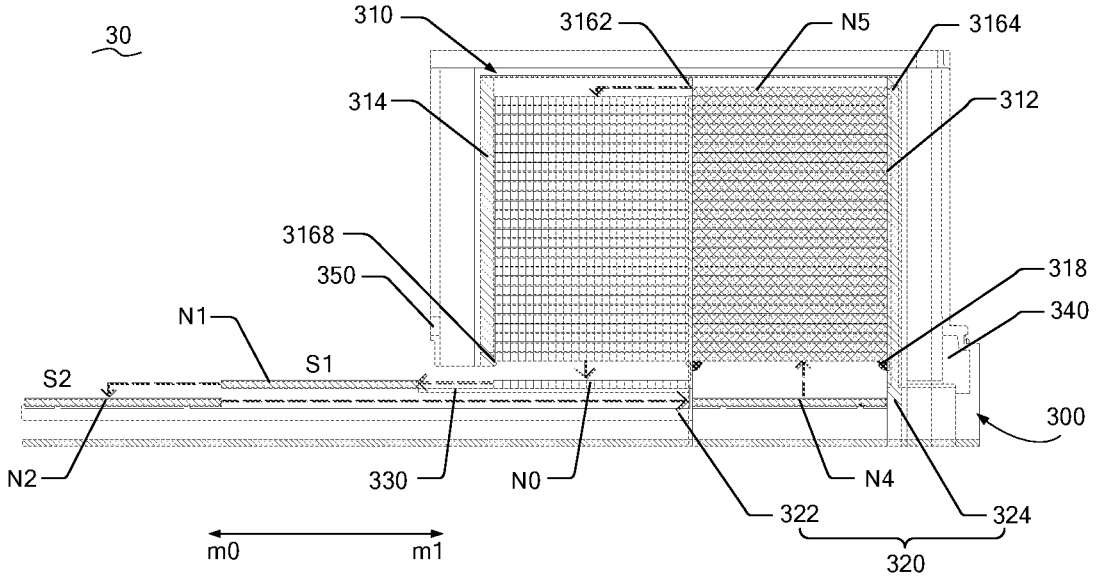
FIG. 7 is a structural schematic view of a base according to an embodiment.

Referring to FIG. 7, FIG. 7 is a structural schematic view of the base 30 according to an embodiment of the present disclosure.

An embodiment of another aspect of the present disclosure provides a base 30, the base 30 can be allow the cleaning robot 10 described in any one of the above technical solutions to park. In the above, the base 30 is provided with a recycling and feeding apparatus 300, the recycling and feeding apparatus 300 is configured to store the cleaning module 20, and feed the stored cleaning module 20 to the cleaning robot 10, and recycle the cleaning module 20 replaced from the cleaning robot 10.

In this way, when the cleaning module 20 of the cleaning robot 10 needs to be replaced, it can return to the position of the base 30, and the cleaning module 20 is fed to the cleaning robot 10 through the recycling and feed apparatus 300, so that the cleaning robot 10 is loaded with the cleaning module 20 from the base 30, and the old cleaning module 20 on the cleaning robot 10 is replaced by the loaded cleaning module 20. In the above, the replaced cleaning module 20 is recycled by the base 30. In this way, there is no need for the user to manually operate to replace the cleaning module 20, and there is no need for the user to recycle or manually supply the cleaning module 20, and the use experience of product is better. In addition, the recycling and feeding apparatus 300 is provided on the base 30, so that the load of the cleaning robot 10 is not additionally increased, and the energy efficiency of the product is higher.

In some embodiments, the recycling and feeding apparatus 300 includes a second replacement mechanism, the second replacement mechanism is configured to replace the cleaning module 20 stored in the recycling and feeding apparatus 300 with the recycled cleaning module 20, wherein the cleaning module 20 replaced through the second replacement mechanism is configured to be fed to the cleaning robot 10.

The second replacement mechanism replaces the stored cleaning module 20 with the recycled cleaning modules 20, so as to facilitate the management of the quantity of the cleaning module 20.

In some embodiments, as shown in FIG. 7, the recycling and feeding apparatus 300 includes a storage apparatus 310 and a first transmission mechanism 320, wherein the storage apparatus 310 is configured to store the cleaning module 20; the first transmission mechanism 320 is configured to transfer the cleaning modules 20 between the storage apparatus 310 and the first replacement mechanism 120.

Further, as shown in FIG. 7, the recycling and feeding apparatus 300 further includes a second transmission mechanism 330, and one of the first transmission mechanism 320 and the second transmission mechanism 330 is configured to receive the cleaning module 20 from the cleaning robot 10, and transfer the cleaning module 20 from the cleaning robot 10 to the storage apparatus 310, and the other is configured to receive the cleaning module 20 provided by the storage apparatus 310 and transfer the cleaning module 20 provided by the storage apparatus 310 to the cleaning robot 10. In this way, the dual-channel 3162 structure including the first transmission mechanism 320 and the second transmission mechanism 330 is formed, which is more conducive to the continuity of the recycling and feeding apparatus 300 for feeding and recycling the cleaning module 20, enables better coordination and matching with the replacement cleaning module 20 at the cleaning robot 10, and is also beneficial for more abundant usage scenarios, such as one base 30 adapting to multiple cleaning robots 10.

In a certain embodiment, as shown in FIG. 7, the storage apparatus 310 defines a first opening that opens in a downward position (i.e. the first opening facing downward), the first transmission mechanism 320 includes a pushing mechanism 322 and a lifting mechanism 324, the pushing mechanism 322 is configured to receive the cleaning module 20 from the cleaning robot 10, and drive the cleaning module 20 from the cleaning robot 10 to below the first opening, the lifting mechanism 324 is configured to transfer the cleaning module 20 between the pushing mechanism 322 and the first opening. The storage apparatus 310 stores the recycled cleaning modules 20 from bottom to top, so that the risk of the cleaning modules 20 being subjected to contamination in the storage apparatus 310 can be greatly reduced.

Figure 8:
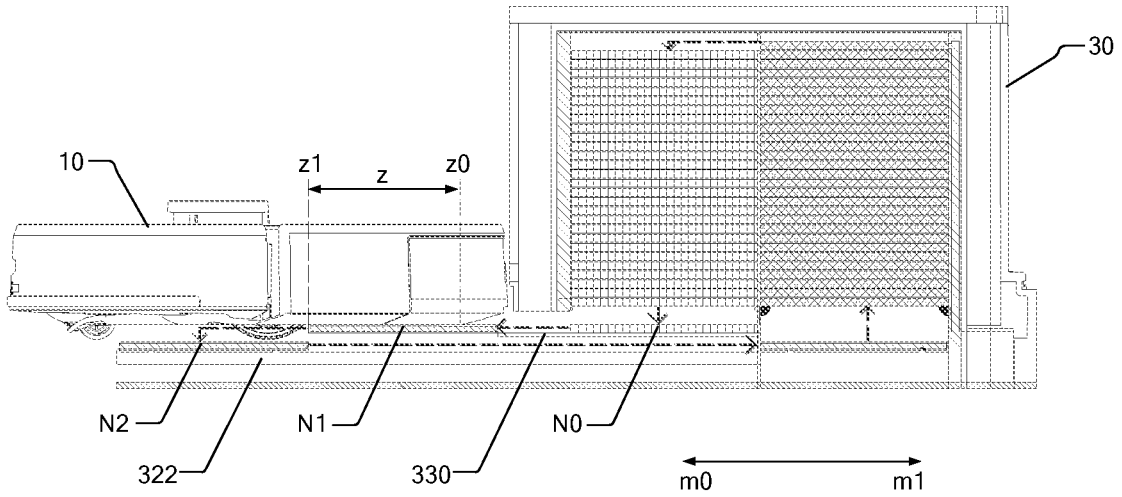
FIG. 8 is a structural schematic view of a cleaning system according to an embodiment.

In a certain embodiment, as shown in FIG. 8, the second transmission mechanism 330 is specifically configured to drive the cleaning module 20 to move, and the movement of the cleaning module 20 under the driving of the second transmission mechanism 330 includes a preset stroke z, wherein when the cleaning module 20 is at the initial position z0 of the preset stroke, the cleaning module 20 roughly reaches the first replacement mechanism 120 of the cleaning robot 10, and when the cleaning module 20 moves from the initial position to the end position z1 of the preset stroke, the cleaning module 20 is loaded to the cleaning robot 10 and replaces the cleaning module 20 carried on the robot apparatus 110, so that the power for replacing the cleaning module 20 on the cleaning robot 10 is provided by the base 30, in this way, it can reduce the power consumption output of the cleaning robot 10, and is conductive to improving the working endurance capability of the cleaning robot 10.

Of course, according to specific requirements, in other embodiments, it is also possible to enable, through the movement of the cleaning robot 10 relative to the base 30, that the power for replacing the cleaning module 20 on the cleaning robot 10 is provided by the cleaning robot 10.

In a certain embodiment, as shown in FIG. 7, the storage apparatus 310 includes a first storage unit 312 and a second storage unit 314, wherein the first storage unit 312 is configured to be able to store the cleaning module 20 from the cleaning robot 10, and the second storage unit 314 is configured to be able to store the cleaning module 20 and supply the stored cleaning module to the cleaning robot 10. In this way, the clean cleaning module 20 and the dirty cleaning module 20 can be stored in partitions, thereby reducing cross-contamination between the cleaning modules 20 and making it more convenient for the user to perform centralized processing of the cleaning modules 20 in the storage apparatus 310 in partitions.

In a certain embodiment, as shown in FIG. 7, the storage apparatus 310 is provided with a second replacement mechanism. More specifically, the second displacement mechanism includes a channel 3162, a drive part 3164 and a weight response part 3168.

Specifically, the channel 3162 communicates with the first storage unit 312 and the second storage unit 314; the driving part 3164 is configured to make a response, in response to an event of the cleaning module 20 entering the first storage unit 312, to drive the cleaning module 20 to move from the first storage unit 312 along the channel 3162 to the second storage unit 314; and the weight response part 3168 is provided in the second storage unit 314, and configured to detect a weight of the cleaning module 20 in the second storage unit 314, and when the weight of the cleaning module 20 in the second storage unit 314 is greater than or equal to a preset weight, the weight response part 3168 causes the second storage unit 314 to discharge the cleaning module 20 in response.

In this way, it is possible to replace the clean cleaning module 20 in the storage apparatus 310 with the recycled cleaning module 20 at the storage apparatus 310, so as to facilitate the management of the quantity of the cleaning modules 20.

Optionally, the base 30 further includes a cleaning apparatus, and the cleaning apparatus is configured to perform clean processing on the cleaning module 20 recycled in the recycling and feeding device 300. For example, the cleaning apparatus includes a water spraying device or a spraying device or the like, wherein by spraying the cleaning liquid on the cleaning module 20 recycled in the storage apparatus 310, the cleaning module 20 is cleaned and stored in the storage apparatus 310. In this way, the base 30 forms a one-stop service for the cleaning robot 10 to recycle, clean and supply the cleaning module 20, which further reduces user intervention requirements, makes the product more intelligent, and lowers the cost of use.

As a further example, as shown in FIG. 7, the cleaning apparatus (not shown in the figure) is configured to perform cleaning processing on the cleaning module 20 in the first storage unit 312.

In some embodiments, the base 30 is further provided with a detection part 350. The detection part 350 is configured to perform in-position detection on the cleaning robot 10.

A Specific Embodiment

As shown in FIG. 7, this specific embodiment provides a base 30, the base 30 includes a first transmission mechanism 320, a second transmission mechanism 330, a first storage unit 312, a second storage unit 314, a driving part 3164, a detection part 350, and a control system 340, etc.

When the robot apparatus 110 of the cleaning robot 10 is controlled to move to the straight line of the front track of the base 30, the detection part 350 is a communication module, and the communication module on the base 30 transmits an alignment signal to the robot apparatus 110 of the cleaning robot 10, and the robot apparatus 110 will move linearly along the track to the fitting docking position of the base 30.

The first transmission mechanism 320 includes a pushing mechanism 322 and a lifting mechanism 324, wherein both the pushing mechanism 322 and the second transmission mechanism 330 are track push-pull mechanisms capable of pushing the cleaning module to move. The driving part 3164 is a telescopic movable part, such as an electromagnetic push rod and the like.

The base 30 is also provided with a controlled movable part, the controlled movable part is connected with the first transmission mechanism 320, the second transmission mechanism 330, and the driving part 3164, etc., the controlled movable part is electrically connected with the controlled system 340, and drives the first transmission mechanism 320, the second transmission mechanism 330, the driving part 3164 and the like to move under the control of the control system 340.

Specifically, the control system 340 makes the controlled movable part control through the operation instruction the telescopic movable part (that is, the driving part 3164) to operate, and pushes one recycled cleaning module N5 in the first storage unit 312 (specifically, for example, the recycling box) into the second storage unit 314 (specifically, for example, a storage box) along the channel 3162. At this time, the weight response part 3168 at the bottom of the second storage unit 314 will sense the weight of the cleaning module N5. In the above, the weight response part 3168 is specifically a rotating support spring (of course, in other embodiments, the weight response part 3168 may also be a locking apparatus that performing opening and closing based on the detection signal of the gravity sensor). When the weight of the cleaning module N5 is sensed, the rotating support spring rotates downward, and at this time, the bottom-most cleaning module of the second storage unit 314 is pushed out (when the weight of the cleaning module N5 is not sensed, the rotating support spring supports cleaning modules in the second storage unit 314). The pushed-out cleaning module NO falls onto the second transmission mechanism 330 below the second storage unit 314. For the first time after the cleaning module NO is pushed out of the second storage unit 314, the rotating support spring rotates upward to operate, effectively supporting the cleaning modules in the second storage unit 314 that are not pushed out.

Specifically again: the control system 340 makes the controlled movable part control through the operation instruction the second transmission mechanism 330 to operate, and moves the cleaning module NO linearly along the track (of course, it can also be rotated in other embodiments) to the fitting docking position (such as the z0 position) of cleaning robot 10, and then pushes the cleaning module NO from the fitting docking position (such as the z0 position) of the cleaning robot 10 into the push-pull track of the cleaning robot 10, until the cleaning module moves to the preset position of the cleaning robot 10 (such as the S1 position, the cleaning module at the S1 position can be understood with reference to the cleaning module N1), during this movement of the cleaning module N1, the movement of the cleaning module N1 is guided by the push-pull track on the cleaning robot 10, and when the cleaning module N1 reaches the preset position, the cleaning module N1 and the cleaning robot 10 are snapped together via the spring fastening parts and the spring fastening parts, and the first magnetic body 134 and the second magnetic body 234 are magnetically connected together (for the old cleaning module originally located on the cleaning robot 10, on the contrary, under the action of the pushing and pressing force of the cleaning module N1, the spring fastening parts and the spring fastening parts between the old cleaning module and the cleaning robot 10 are automatically disconnected and the acting force of the magnetic components is released), and just at the moment when the cleaning module N1 reaches the preset position, the cleaning module N1 pushes the old cleaning module linearly out along the push-pull track in a m0 direction, in this way, when the cleaning module N1 is assembled on the cleaning robot 10, the cleaning module originally located on the cleaning robot 10 is replaced simultaneously (the replaced cleaning module can be understood with reference to the cleaning module N2), and the replaced cleaning module N2 falls onto the S2 position of the pushing mechanism 322.

Specifically again: the control system 340 makes controlled movable part control through the operation instruction the pushing mechanism 322 to retract to directly below the first storage unit 312 of the base 30, so that the replaced cleaning module N2 is carried to directly below the first storage unit 312 accordingly (the cleaning module located directly below the first storage unit 312 can be understood with reference to the cleaning module N4).

Specifically again: the control system 340 makes the controlled movable part control through the operation instruction the lifting mechanism 324 to lift the position of the cleaning module N4, so that the cleaning module N4 pushes away the support part 318 at the bottom opening of the first storage unit 312 to be recycled into the first storage unit 312.

In this solution, the control system 340 on the base 30 sends an instruction to make the controlled movable part, the first transmission mechanism 320, the second transmission mechanism 330, the driving part 3164, the detection part 350, the weight response part 3168, etc. do a series of continuous actions, truly realizing the efficient and fast automatic assembling and disassembling of cleaning modules to the cleaning robot 10, and realizing product intelligence and better use experience.

Please refer to FIG. 8, FIG. 8 is a structural schematic view of the cleaning system according to an embodiment of the present disclosure.

An embodiment of another aspect of the present disclosure provides a cleaning system, which includes: a cleaning robot 10 and a base 30; the cleaning robot 10 is the cleaning robot 10 described in any one of the above technical solutions, or the base 30 is the base 30 described in any one of the above technical solutions.

In some embodiments, optionally, the cleaning robot 10 can move along a preset trajectory relative to the base 30, and move along the preset trajectory relative to the base 30 through the cleaning robot 10, and can provide a driving force for loading the cleaning module on the base 30 to the cleaning robot 10 and replacing the cleaning module carried on the cleaning robot 10 with the loaded cleaning module.

In the present disclosure, the cleaning robot 10 of the cleaning system can carry a cleaning module for use, when a new cleaning module is loaded to the cleaning robot 10, the loaded new cleaning module replaces the old cleaning module originally carried on the cleaning robot 10, in this way, the cleaning modules on the cleaning robot 10 can be assembled and disassembled synchronously, and the replacement of the cleaning module on the cleaning robot 10 is more convenient and time-saving.

Although the present disclosure has been described with reference to several exemplary embodiments, it is to be understood that the terminology used is a descriptive and illustrational, and nonrestrictive terminology. Since the present disclosure can be specifically implemented in many forms without departing from the spirit or essence of the present disclosure, it is to be understood that the above-described embodiments are not limited to any of the foregoing details, but are to be construed broadly within the spirit and scope defined by the appended claims, therefore, all changes and modifications that fall within the scope of the claims or equivalents thereof should be covered by the appended claims.

What is claimed is:

1. A cleaning system, comprising:

a cleaning robot and a base, wherein the cleaning robot comprises:

a robot apparatus, configured to carry at least one first cleaning module; and a first replacement mechanism, configured to enable the robot apparatus to be loaded with at least one second cleaning module, and enable a first cleaning module in the at least one first cleaning module carried on the robot apparatus to be replaced with a second cleaning module in the at least one second cleaning module, wherein the first replacement mechanism comprises:

a first guide connecting structure, provided on the robot apparatus, wherein a loading portion and an unloading portion are provided on the first guide connecting structure, and the first guide connecting structure is configured to allow the at least one second cleaning module to be loaded on the robot apparatus along the loading portion, allow the at least one first cleaning module to be separated from the robot apparatus along the unloading portion, and allow the at least one first cleaning module and the at least one second cleaning module to move relative to the robot apparatus along the first guide connecting structure;

wherein when the first cleaning module is originally carried on the robot apparatus, during a process in which the second cleaning module is loaded onto the robot apparatus via the loading portion and moves along the first guiding connecting structure, the first cleaning module originally carried on the robot apparatus is pushed out from the robot apparatus via the unloading portion;

the base is configured to allow the cleaning robot to park, wherein the base comprises:

a recycling and feeding apparatus, configured to store the second cleaning module, feed the stored second cleaning module to the cleaning robot, and recycle the first cleaning module replaced from the cleaning robot; wherein the recycling and feeding apparatus comprises:

a storage apparatus, configured to store the second cleaning module; and a first transmission mechanism, configured to transfer the second cleaning module between the storage apparatus and the first replacement mechanism; wherein the storage apparatus comprises:

a first storage unit, configured to store the first cleaning module from the cleaning robot;

a second storage unit, configured to store the second cleaning module and supply the stored second cleaning module to the cleaning robot;

a channel, communicating with the first storage unit and the second storage unit;

a driving part, configured to make a response, in response to an event of the first cleaning module entering the first storage unit, to drive the first cleaning module to move from the first storage unit along the channel to the second storage unit; and a weight response part, provided in the second storage unit, and configured to detect a weight of the second cleaning module in the second storage unit, wherein when the weight of the second cleaning module in the second storage unit is greater than or equal to a preset weight, the weight response part causes the second storage unit to discharge the second cleaning module in response.

2. The cleaning system according to claim 1, wherein the recycling and feeding apparatus comprises:

a second replacement mechanism, configured to replace the second cleaning module stored in the recycling and feeding apparatus with the recycled first cleaning module, wherein the second cleaning module replaced through the second replacement mechanism is configured to be fed to the cleaning robot;

wherein the second replacement mechanism comprising the channel, the drive part, and the weight response part.

3. The cleaning system according to claim 1, wherein the recycling and feeding apparatus further comprises a second transmission mechanism, and one of the first transmission mechanism and the second transmission mechanism is configured to receive the first cleaning module from the cleaning robot and transfer the first cleaning module from the cleaning robot to the storage apparatus, and the other is configured to receive the second cleaning module provided by the storage apparatus and transfer the second cleaning module provided by the storage apparatus to the cleaning robot.

4. The cleaning system according to claim 3, wherein the storage apparatus defines a first opening that opens in a downward position, the first transmission mechanism comprises a pushing mechanism and a lifting mechanism, the pushing mechanism is configured to receive the first cleaning module from the cleaning robot, and drive the first cleaning module from the cleaning robot to below the first opening, and the lifting mechanism is configured to transfer the first cleaning module between the pushing mechanism and the first opening; and the second transmission mechanism is configured to drive the second cleaning module to move, and a movement of the second cleaning module under driving of the second transmission mechanism comprises a preset stroke, wherein when the second cleaning module is in an initial position of the preset stroke, the second cleaning module reaches the first replacement mechanism of the cleaning robot, when the second cleaning module moves from the initial position to an end position of the preset stroke, the second cleaning module is loaded to the cleaning robot and replace the first cleaning module carried on the robot apparatus.

5. The cleaning system according to claim 1, further comprising:

a cleaning apparatus, configured to perform cleaning processing on the first cleaning module recycled in the recycling and feeding apparatus.

6. The cleaning system according to claim 1, wherein the first guide connecting structure comprises one of a push-pull track and a track adaptation part; and/or the first replacement mechanism comprises one first guide connecting structure or at least two first guide connecting structures provided at intervals.

7. The cleaning system according to claim 6, wherein the cleaning robot further comprises:

a first connecting structure, configured to be detachably connected to the first cleaning module, wherein the first connecting structure is provided in association with the first guide connecting structure to define a preset position, wherein when the first cleaning module moves to the preset position along the first guide connecting structure, the first connecting structure is connected with the first cleaning module, and when the first cleaning module is separated from the preset position, the first connecting structure is detached from the first cleaning module.

8. The cleaning system according to claim 1, wherein the cleaning robot further comprises:

a first connecting structure, configured to be detachably connected to the first cleaning module, wherein the first connecting structure is provided in association with the first guide connecting structure to define a preset position, wherein when the first cleaning module moves to the preset position along the first guide connecting structure, the first connecting structure is connected with the first cleaning module, and when the first cleaning module is separated from the preset position, the first connecting structure is detached from the first cleaning module.

9. The cleaning system according to claim 8, wherein the first connecting structure comprises at least one of a first fastening part and a first magnetic body.

10. The cleaning system according to claim 1, wherein the recycling and feeding apparatus is configured to store the second cleaning module, feed the stored second cleaning module to the first replacement mechanism, and recycle the first cleaning module replaced through the first replacement mechanism.

11. The cleaning system according to claim 1, wherein each of the first cleaning module and the second cleaning module comprises:

a body part; and a replacement adaptation structure, provided on the body part, and configured to cooperate with the cleaning robot, so that the second cleaning module can be loaded to the cleaning robot and can replace the first cleaning module carried on the cleaning robot; and the first cleaning module is movably attached to the cleaning robot, and through the relative movement between the first cleaning module and the cleaning robot, the second cleaning module can be loaded to the cleaning robot, and the first cleaning module carried on the cleaning robot is replaced with the loaded second cleaning module.

12. The cleaning system according to claim 11, wherein the replacement adaptation structure comprises at least one second guide connecting structure, the second guide connecting structure is provided on the body part, the second guide connecting structure has one end provided with a first interface, and the other end provided with a second interface, the second guide connecting structure is configured to be loaded to the cleaning robot along the first interface and allow the second cleaning module to be movably attached to the cleaning robot, and the second interface is configured to allow the second guide connecting structure to be separated from the cleaning robot along the second interface;

the at least one second guide connecting structure comprises one of a push-pull track and a track adaptation part;

the replacement adaptation structure comprises one second guide connecting structure or at least two second guide connecting structures provided at intervals; and the body part comprises one or a combination of more of a mopping and wiping part, a water tank, and a dust box.

13. The cleaning system according to claim 11, wherein each of the first cleaning module and the second cleaning module further comprises:

a second connecting structure, configured to be detachably connected to the cleaning robot, wherein the second connecting structure comprises at least one of a second fastening part and a second magnetic body.

* * * * *